United States Patent [19]

Koshimoto et al.

[11] Patent Number: 4,915,066

[45] Date of Patent: Apr. 10, 1990

[54] VALVE TRAIN FOR V-TYPE DOUBLE-OVERHEAD-CAMSHAFT ENGINE

[75] Inventors: Naohide Koshimoto; Shigeki Nakatani, both of Hiroshima, Japan

[73] Assignee: Mazda Motor Corporation, Hiroshima, Japan

[21] Appl. No.: 379,975

[22] Filed: Jul. 14, 1989

[30] Foreign Application Priority Data

Jul. 20, 1988 [JP] Japan ..... 63-180658
Jul. 29, 1988 [JP] Japan ..... 63-190101

[51] Int. Cl.[4] ..... F01L 1/02; F01M 9/10

[52] U.S. Cl. ..... 123/90.27; 123/90.31; 123/90.34

[58] Field of Search ..... 123/90.27, 90.31, 90.34, 123/55 V, 55 VF, 55 VS, 55 VE

[56] References Cited

U.S. PATENT DOCUMENTS

| | | | |
|---|---|---|---|
| 4,610,224 | 9/1986 | Fujita | 123/90.27 |
| 4,617,882 | 10/1986 | Matsumoto | 123/90.27 |
| 4,658,769 | 4/1987 | Horio et al. | 123/90.27 |
| 4,674,452 | 6/1987 | Asanomi | 123/90.27 |
| 4,716,864 | 1/1988 | Binder | 123/90.27 |
| 4,729,348 | 3/1988 | Okada et al. | 123/90.27 |
| 4,840,149 | 6/1989 | Fujita | 123/90.34 |

FOREIGN PATENT DOCUMENTS 61-232305 10/1986 Japan .

62-76205 5/1987 Japan .

*Primary Examiner*—Willis R. Wolfe
*Assistant Examiner*—Weilun Lo
*Attorney, Agent, or Firm*—Sixbey, Friedman, Leedom & Ferguson

[57] ABSTRACT

A V-type DOHC engine has first and second banks. The end of the cylinder row in the first bank on one end of the engine retracts from that of the cylinder row in the second bank. A first camshaft in each bank is driven by the crankshaft by way of a first transmission mechanism which is disposed on said one end of the engine, and the first and second camshafts in each bank are connected by a second transmission mechanism which is disposed between the first transmission mechanism and the cylinder row of the bank. The end portion of the first camshaft in the first bank on said one end of the engine is supported by a pair of bearings one disposed between the first and second transmission mechanisms and the other disposed between the second power transmission mechanism and the cylinder row in the first bank. The end portion of the second camshaft in the first bank on said one end of the engine is supported by a bearing disposed between the second transmission mechanism and the cylinder row in the first bank. The end portion of each of the camshafts in the second bank on said one end of the engine is supported by a bearing disposed between the first and second transmission mechanisms.

11 Claims, 6 Drawing Sheets

VALVE TRAIN FOR V-TYPE DOUBLE-OVERHEAD-CAMSHAFT ENGINE

BACKGROUND OF THE INVENTION

1. Field of the Invention

This invention relates to a valve train for a V-type double-overhead-camshaft engine in which a pair of camshafts are mounted over each cylinder bank.

2. Description of the Prior Art

As disclosed in Japanese Unexamined Patent Publication No. 61(1986)-232305, there has been known a valve train for a V-type DOHC engine in which a timing belt is passed around the crankshaft and one of the pair of camshafts in each cylinder bank and a chain is passed around the pair of camshafts in each cylinder bank in order to revolve the camshafts in synchronization with the crankshaft. In such a V-type DOHC engine, one of the camshafts in each cylinder bank is provided with a power receiving means such as a pulley which receives the power transmitted thereto from the crankshaft and with a power delivering means such as a pulley which transmits the power, which the power receiving means receives, to the other camshaft in each cylinder bank, and said the other camshaft in each cylinder bank is provided with a power receiving means such as a pulley which receives the power transmitted thereto. Accordingly, the camshafts should be supported for revolution on the corresponding cylinder heads with a high rigidity, and further, the overall structure of the valve train of the engine is required to be as compact as possible.

SUMMARY OF THE INVENTION

In view of the foregoing observations and description, the primary object of the present invention is to provide a valve train for V-type DOHC engine which is compact in structure and in which the camshafts are supported with a sufficient rigidity.

In accordance with the present invention, there is provided a valve train for a V-type double overhead camshaft engine which has first and second cylinder banks whose cylinder rows are offset from each other in the direction of the crankshaft so that the end of the cylinder row in the first cylinder bank on one end of the engine retracts from that of the cylinder row in the second cylinder bank, and in which a first camshaft in each cylinder bank is drivingly connected to the crankshaft of the engine by a first power transmission mechanism which is disposed on the end of the respective cylinder banks on said one end of the engine, and the first camshaft in each cylinder bank is drivingly connected with a second camshaft by a second power transmission mechanism which is disposed between the first power transmission mechanism and the cylinder row of the cylinder bank, characterized in that the end portion of said first camshaft in the first cylinder bank which extends beyond the end of the cylinder row on said one end of the engine is supported by a pair of bearings one disposed between the first and second power transmission mechanisms and the other disposed between the second power transmission mechanism and the cylinder row in the first cylinder bank, the end portion of said second camshaft in the first cylinder bank which extends beyond the end of the cylinder row on said one end of the engine is supported by a bearing disposed between the second power transmission mechanism and the cylinder row in the first cylinder bank, and the end portion of each of the camshafts in the second cylinder bank which extends beyond the end of the cylinder row on said one end of the engine is supported by a bearing disposed between the first and second power transmission mechanisms.

DESCRIPTION OF THE PREFERRED EMBODIMENT

Figure 1:
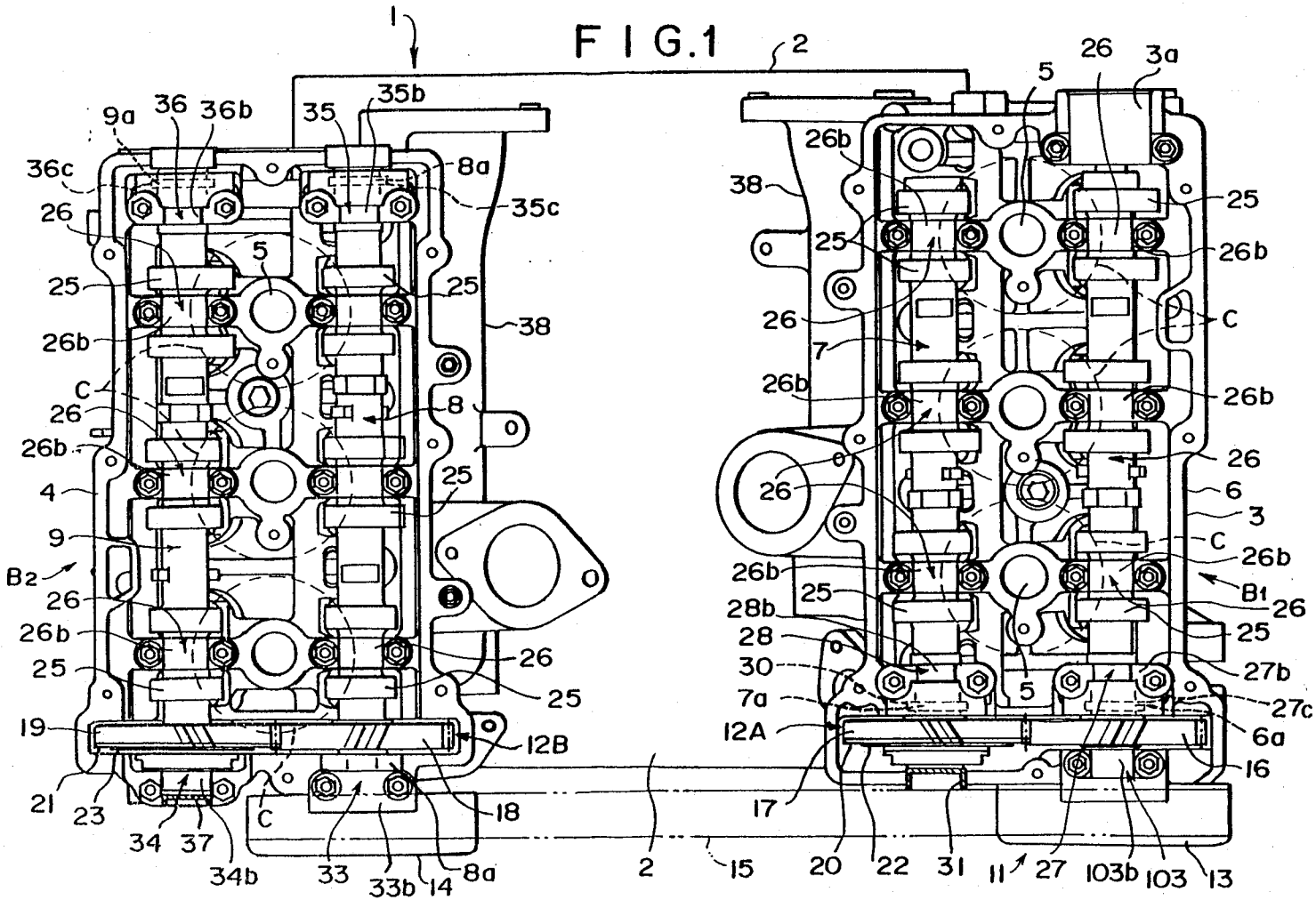
FIG. 1 is a schematic plan view which shows a V-6 DOHC engine provided with a valve train in accordance with an embodiment of the present invention in developed state.
Figure 2:
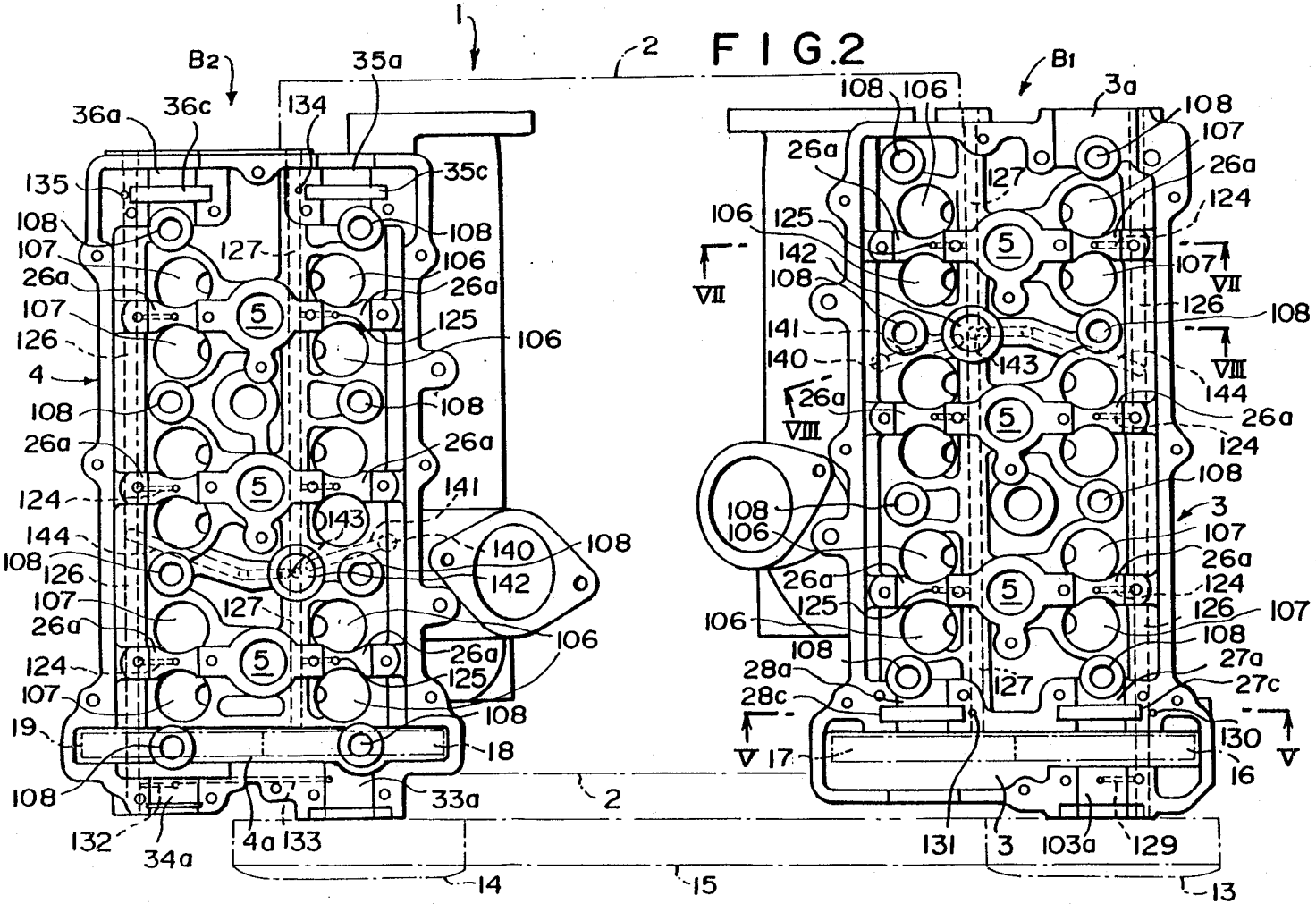
FIG. 2 is a view similar to FIG. 1 but with the camshafts removed.
Figure 3:
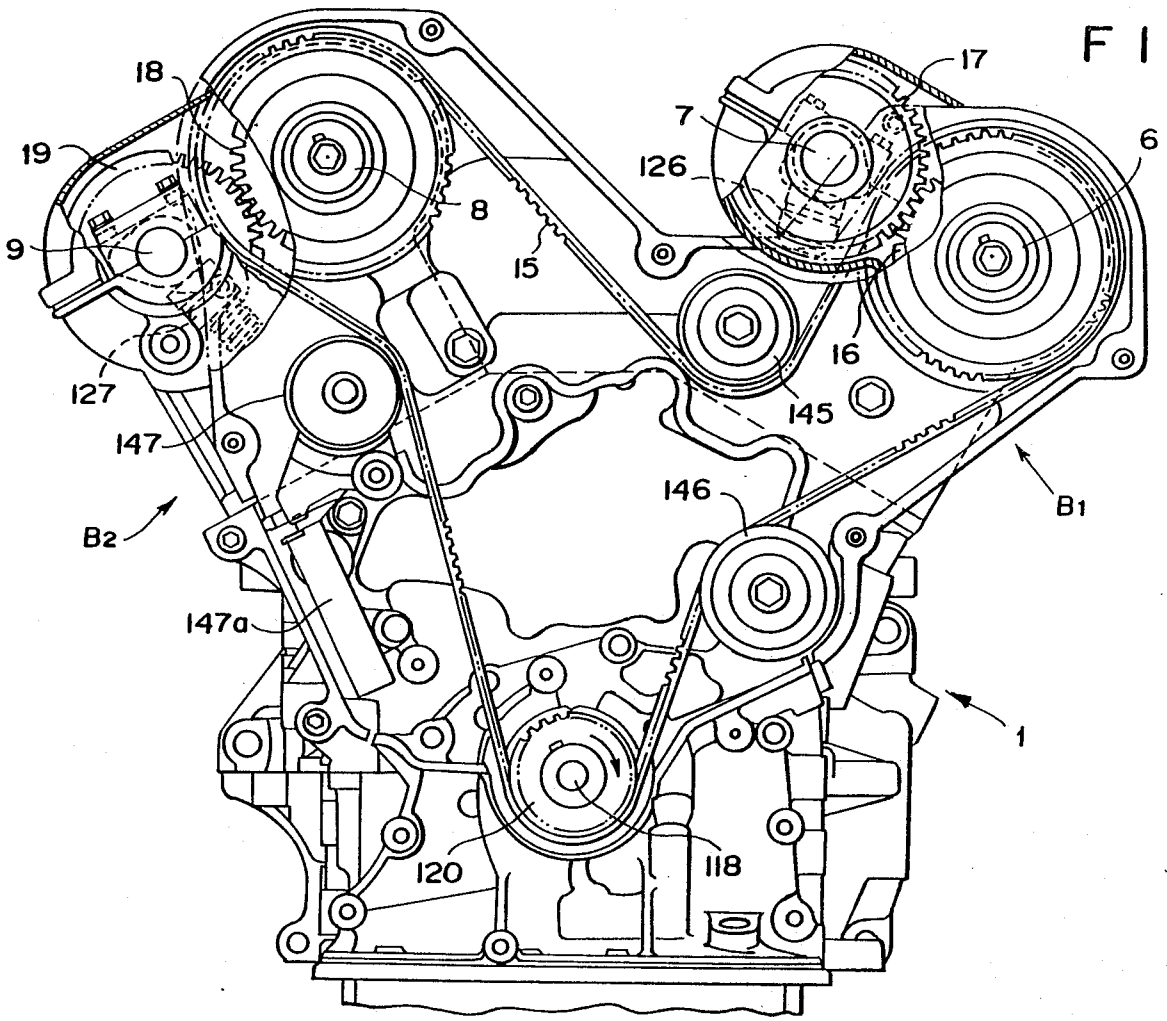
FIG. 3 is a front view of the engine shown in FIG. 1.

In FIGS. 1 to 3, a V-6 DOHC engine 1 provided with a valve train in accordance with an embodiment of the present invention includes a cylinder block 2 on which first and second cylinder head 3 and 4 are formed at an angle to each other. First and second cylinder banks B1 and B2 each having three cylinders C are formed on the first and second cylinder heads 3 and 4, respectively. Reference numeral 5 denotes a plug hole for the cylinder. The cylinder rows in the first and second cylinder banks Bl and B2 are offset from each other in the direction of the crankshaft 118 (FIG. 3) so that the end of the cylinder row in the first cylinder bank B1 on a first end of the engine (the lower end as seen in FIG. 1) retracts from that of the cylinder row in the second cylinder bank B2. In this specification, as for the parts extending in the direction of the crankshaft 118, the lower end as seen in FIG. 1 will be referred to as "the first end" and the upper end as shown in FIG. 1 will be referred to as "the second end", hereinbelow.

Each cylinder is provided with two exhaust valves 127 and two intake valves 126 (FIG. 3). Reference numerals 106 and 107 in FIG. 2 respectively denotes the intake port and exhaust port. The intake valves and the exhaust valves for the cylinders in the first cylinder bank B1 are driven by first and second camshafts 6 and 7, and the intake valves and the exhaust valves for the cylinders in the second cylinder bank B2 are driven by the third and second camshafts 8 and 9.

The first camshaft 6 and the third camshaft 8 are driven by the crankshaft 118 by way of a first power transmission mechanism 11 which comprises a first cam pulley 13 fixed to the first end of the first camshaft 6, a second cam pulley 14 fixed to the first end of the third camshaft 8, a crank pulley 120 fixed to the first end of the crankshaft 118 and a timing belt 15 which is passed around the cam pulleys 13 and 14 and the crank 15 pulley 120. Reference numerals 145 and 146 (FIG. 3) respectively denote idlers, and a reference numeral 147 denotes an auto-tensioner having an oil damper 147*a*.

The second and fourth camshafts 7 and 9 are shorter than the first and third camshafts 6 and 8 and are substantially equal to the length of the cylinder heads 3 and 4. The second camshaft 7 is driven by the first camshaft 6 by way of a second power transmission mechanism 12A which comprises helical gears 16 and 17 which are fixed to the first and second camshafts 6 and 7 at portions between the first power transmission mechanism 11 and the cylinder row in the first cylinder bank B1 and are in mesh with each other. Similarly, the fourth camshaft 9 is driven by the third camshaft 8 by way of a third power transmission mechanism 12B which comprises helical gears 18 and 19 which are fixed to the third and fourth camshafts 8 and 9 at portions between the first power transmission mechanism 11 and the cylinder row in the second cylinder bank B2 and are in mesh with each other.

A helical friction gear 20 is mounted on the second camshaft 7 and is able to revolve relative to the helical gear 17. The helical friction gear 20 is in mesh with the helical gear 16 on the first camshaft 6 and is pressed against the helical gear 17 on the second camshaft 7 by a spring 22. Similarly, a helical friction gear 21 is mounted on the fourth camshaft 9 and is able to revolve relative to the helical gear 19. The helical friction gear 21 is in mesh with the helical gear 18 on the third camshaft 8 and is pressed against the helical gear 19 on the fourth camshaft 9 by a spring 23. The number of the teeth of the friction gears 22 and 23 are respectively larger than the number of the teeth of the helical gears 17 and 19 by one. The friction gears 22 and 23 respectively urge the helical gears 17 and 19 in the direction of their revolution and reduces the backlash between the helical gears 16 and 17 and between the helical gears 18 and 19, thereby reducing the gear noise. As can be understood from the description above, the second power transmission mechanism 12A and the third power transmission mechanism 12B are substantially the same in structure and accordingly, they will be sometimes generically referred to as "the second power transmission mechanism 12", hereinbelow. The gears 16, 17 and 22 are accommodated in a gear housing portion **3*b* formed in the first cylinder head 3, and the gears 18, 19 and 23 are accommodated in a gear housing portion 4*a* formed in the second cylinder head 4**.

Each of the camshafts 6 to 9 are provided with a pair of cam portions 25 for each cylinder. The intermediate portion of each camshaft is supported for revolution on the cylinder head by intermediate bearings 26 each disposed between the cam portions 25 for each cylinder. Each intermediate bearing 26 comprises a lower half **26*a* formed on the cylinder head and an upper half 26*b* which is opposed to the lower half 26*a*** with the camshaft intervening therebetween and is fixed to the cylinder head by bolts.

The first end portion of the first camshaft 6 which extends beyond the end of the cylinder row in the first cylinder bank Bl is supported by a thrust bearing 27 disposed between the second power transmission mechanism 12A and the cylinder row in the first cylinder bank B1 and by a first end bearing 103 provided on the first end of the first cylinder head 3 between the first power transmission mechanism 11 and the second power transmission mechanism 12. The thrust bearing 27 comprises a lower half **27*a* formed on the cylinder head 3 and an upper half 27*b* which is opposed to the lower half 27*a* with the first camshaft 6 intervening therebetween and is fixed to the cylinder head 3 by bolts. A thrust limiting groove 27*c* is formed in the lower half 27*a* and a thrust collar portion 6*a* formed on the first camshaft 6 is engaged with the thrust limiting groove 27*c*, thereby limiting the axial movement of the first camshaft 6. The first end bearing 103 comprises a lower half 103*a* formed on the cylinder head 3 and an upper half 103*b* which is opposed to the lower half 103*a* with the first camshaft 6 intervening therebetween and is fixed to the cylinder head 3 by bolts. The first end portion of the second camshaft 7 which extends beyond the end of the cylinder row in the first cylinder bank B1 is supported by only a thrust bearing 28 which is substantially the same as the thrust bearing 27 in structure and is disposed between the second power transmission mechanism 12A and the cylinder row in the first cylinder bank B1. The thrust bearing 28 comprises a lower half 28*a* formed on the cylinder head 3 and an upper half 28*b* which is opposed to the lower half 28*a* with the first camshaft 6 intervening therebetween and is fixed to the cylinder head 3 by bolts. A thrust limiting groove 28*c* is formed in lower half 28*a* and a thrust collar portion 7*a* formed on the second camshaft 7 is engaged with the thrust limiting groove 28*c*, thereby limiting the axial movement of the second camshaft 6**.

A distributor mounting portion **3*a* is formed on the first cylinder head 3 and a distributor (not shown) which is driven by the first camshaft 6 is mounted on the distributor mounting portion 3*a*. A machining hole for machining the inside of the cylinder head 3 is formed in the first cylinder head 3 at a portion opposed to the front end of the second camshaft 7 and is closed by a plug 31**.

The first end portion of the third camshaft 8 which extends beyond the end of the cylinder row in the second cylinder bank B2 is supported by a first end bearing 33 provided on the first end of the second cylinder head 4 between the first power transmission mechanism 11 and the second power transmission mechanism 12 and the second end portion of the third camshaft 8 is supported by a thrust bearing 35 formed on the second end of the second cylinder head 4. The thrust bearing 35 comprises a lower half **35*a* formed on the cylinder head 4 and an upper half 35*b* which is opposed to the lower half 35*a* with the third camshaft 8 intervening therebetween and is fixed to the cylinder head 4 by bolts. A thrust limiting groove 35*c* is formed in lower half 35*a* and a thrust collar portion 8*a* formed on the third camshaft 8 is engaged with the thrust limiting groove 35*c*, thereby limiting the axial movement of the third camshaft 8. The first end bearing 33 comprises a lower half 33*a* formed on the cylinder head 4 and an upper half 33*b* which is opposed to the lower half 33*a* with the third camshaft 8 intervening therebetween and is fixed to the cylinder head 4 by bolts. Similarly, the first end portion of the fourth camshaft 9 which extends beyond the end of the cylinder row in the second cylinder bank B2 is supported by a first end bearing 34 provided on the first end of the second cylinder head 4 between the first power transmission mechanism 11 and the second power transmission mechanism 12 and the second end portion of the fourth camshaft 9 is supported by a thrust bearing 36 formed on the second end of the second cylinder head 4. The thrust bearing 36 comprises a lower half 36*a* formed on the cylinder head 4 and an upper half 36*b* which is opposed to the lower half 36*a* with the fourth camshaft 9 intervening therebetween and is fixed to the cylinder head 4 by bolts. A thrust limiting groove 36*c* is formed in lower half 36*a* and a thrust collar portion 9*a* formed on the fourth camshaft 9 is engaged with the thrust limiting groove 36*c*, thereby limiting the axial movement of the fourth camshaft 9. The first end bearing 34 comprises a lower half 34***a* formed on the cylinder head 4 and an upper half 34*b* which is opposed to the lower half 34*a* with the fourth camshaft 9 intervening therebetween and is fixed to the cylinder head 4 by bolts. A machining hole for machining the inside of the cylinder head 4 is formed in the second cylinder head 4 at a portion opposed to the second end of the fourth camshaft 9 and is closed by a plug 37. Reference numeral 38 in FIG. 1 denotes an intake manifold. Reference numeral 108 in FIG. 8 denotes a bolt hole into which a bolt for fixing the cylinder head to the cylinder block 2 is inserted.

In this embodiment, the lengths of the first and second camshafts 6 and 7 in the first cylinder bank B1 between the second power transmission mechanism 12 and the intermediate bearing 26 adjacent thereto are larger than those of the third and fourth camshafts 8 and 9 in the second cylinder bank B2, since the end of the cylinder row in the first cylinder bank B1 on the first end of the engine retracts from that of the cylinder row in the second cylinder bank B2. The end portions of the first and second camshafts 6 and 7 which extend beyond the cylinder row are supported by the thrust bearings 27 and 28 which are disposed between the second power transmission mechanism 12 and the cylinder row. This arrangement increases the supporting rigidity of the first and second camshafts 6 and 7. Further, with this arrangement, the supporting rigidity of the camshafts 6 and 7 can be increased without increasing the overall size of the engine since the bearings 27 and 28 are disposed in the space between the second power transmission mechanism 12 and the cylinder row which would be a dead space.

With reference to FIGS. 2 and 4 to 8, the first cylinder head 3 is provided with outer and inner lubricant passage 126 and 127 which extend in parallel to the crankshaft 118. As clearly shown in FIG. 4 or 7, an outer communicating passage 124 extends substantially vertically downward from each of the lower halves 26*a* of the intermediate bearings 26 for the first camshaft 6 and communicates with the outer lubricant passage 126, and an inner communicating passage 125 extends substantially vertically downward from each of the lower halves 26*a* of the intermediate bearings 26 for the second camshaft 7 and communicates with the outer lubricant passage 127. The second cylinder head 4 is provided with out and inner lubricant passages 126 and 127 and outer and inner communicating passages 124 and 125 in the similar manner.

Each of the outer lubricant passages 126 which are formed in the first and second cylinder heads 3 and 4 along the outer ones of the camshafts in the respective cylinder banks, i.e., the first and fourth camshafts 6 and 9, extends from the second end of the cylinder head to below the corresponding first end bearing (103, 34), and is radially spaced from the center of the bearing 26 by a distance larger than the radius of the gear (16, 19). Each of the inner lubricant passages 127 which are formed in the first and second cylinder heads 3 and 4 along the inner ones of the camshafts in the respective cylinder banks, i.e., the second and third camshafts 7 and 8, extends from the second end of the cylinder head to a portion just behind the helical gear (17, 18), and is radially spaced from the center of the bearing 26 by a distance smaller than the radius of the gear (17, 18). Each inner lubricant passage 127 is drilled through a machining hole 127*a* which is closed by a plug ater the lubricant passage is drilled. Further, the first and second ends of the lubricant passages 126 and 127 are closed by plugs.

A first end communicating passage 129 similar to the communicating passage 124 communicates the lower half 103*a* of the first end bearing 103 with the first end portion of the outer lubricant passage 126 in the first cylinder head 3. Further a communicating passage 130 extends in the cylinder head 3 in perpendicular to the top surface of the cylinder head 3 and communicates the lower half 27*a* of the thrust bearing 27 with the outer lubricant passage 126. Further, a communicating passage 131 extends in the cylinder head 3 in perpendicular to the top surface of the cylinder head 3 and communicates the lower half 28*a* of the thrust bearing 28 with the inner lubricant passage 127. Further, a first end communicating passage 132 similar to the communicating passage 124 communicates the lower half 34*a* of the first end bearing 34 for the fourth camshaft 9 with the first end portion of the outer lubricant passage 126 in the second cylinder head 4. Further, a longer first end communicating passage 133 communicates the lower half 33*a* of the first end bearing 33 for the third camshaft 8 with the first end portion of the outer lubricant passage 126 in the second cylinder head 4. A communicating passage 134 extends in the cylinder head 4 in perpendicular to the top surface of the cylinder head 4 and communicates the lower half 35*a* of the thrust bearing 35 with the inner lubricant passage 127. A communicating passage 135 extends in the cylinder head 4 in perpendicular to the top surface of the cylinder head 4 and communicates the lower half 36*a* of the thrust bearing 36 with the outer lubricant passage 126.

Figure 5:
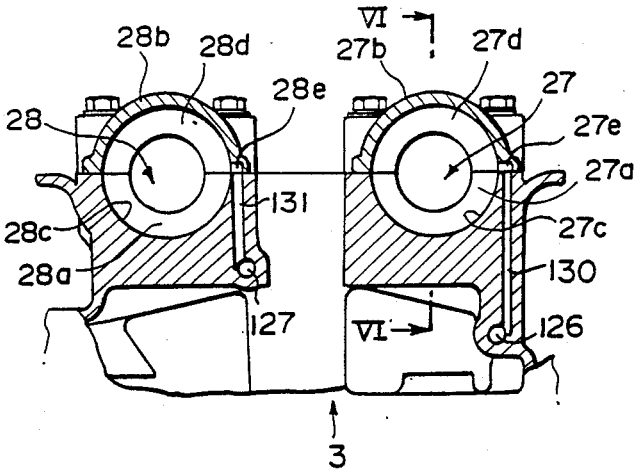
FIG. 5 is a cross-sectional view taken along line V—V in FIG. 2.
Figure 6:
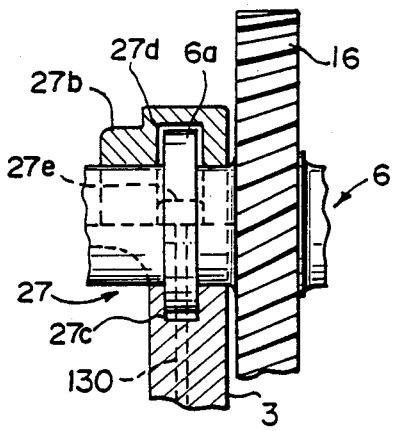
FIG. 6 is a cross-sectional view taken along line VI—VI in FIG. 5.
Figure 7:
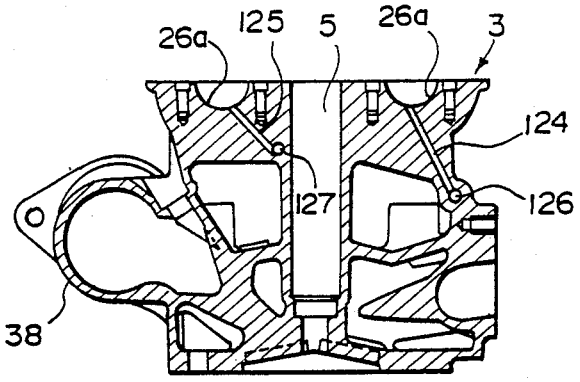
FIG. 7 is a cross-sectional view taken along line VII—VII in FIG. 2.

As shown in FIGS. 5 and 6, the communicating passages 130 and 131 respectively opens at portions near the thrust limiting grooves 27*c* and 28*c* in the lower halves 27*a* and 28*a* of the thrust bearings 27 and 28. The upper halves 27*b* and 28*b* which respectively form the thrust bearings 27 and 28 together with the lower halves 27*a* and 28*a* are respectively provided with upper thrust limiting grooves 27*d* and 28*d*. Further, recesses 27*e* and 28*e* are formed on the upper halves 27 and 28 and communicate the respective thrust limiting grooves 27*c* and 28*c* with the communicating passages 130 and 131 when the upper halves 27*b* and 28*b* are fixed to the cylinder head 3 in a predetermined position with respect to the lower halves 27*b* and 28*b*. The thrust limiting grooves 27*c* and 28*c* in the lower halves 27*a* and 28*a* have a width smaller than the thickness of the collar portions 6*a* and 7*a* so as to limit the axial movement of the first and second camshafts 6 and 7. On the other hand, the thrust limiting grooves 27*d* and 28*d* in the upper halves 27*b* and 28*b* have a width larger than the thickness of the collar portions 6*a* and 7*a* so as to permit the lubricants to flow the space between the collar portions and the upper halves of the thrust bearings and to permit the air in the passages to escape. The thrust bearings 35 and 36 in the second cylinder head 4 are the same as the thrust bearing 27 and 28 in the first cylinder head 3 and will not be described here.

Figure 4:
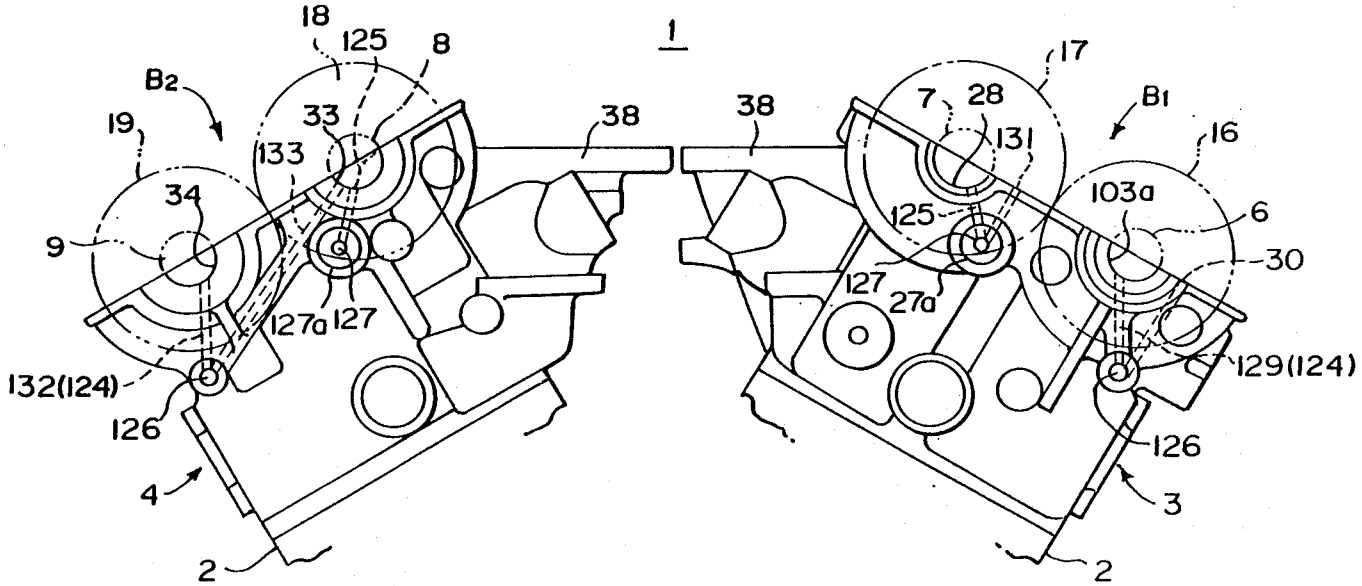
FIG. 4 is a schematic fragmentary view showing a part of the engine.

As can be understood from FIGS. 3 and 4, the top surfaces of the cylinder heads 3 and 4 are inclined outwardly downward, and the communicating passages 124, 129 and 132 which communicates with the outer lubricant passages 126 are longer than the communicating passages 125 which communicates with the inner lubricant passages 127. That is, as can be understood from FIG. 7, if the inner communicating passages 125 are long, they will interfere with the plug holes 5. The outer lubricant passages 126 are radially spaced from the center of the bearing 26 by a distance larger than the radius of the gears 16 and 19 so that they can extend to the first end bearings 103, 33 and 34 without interfering with the gears 16 and 19 and feed lubricant to the bearings through the communicating passages 129, 132 and 133.

Figure 8:
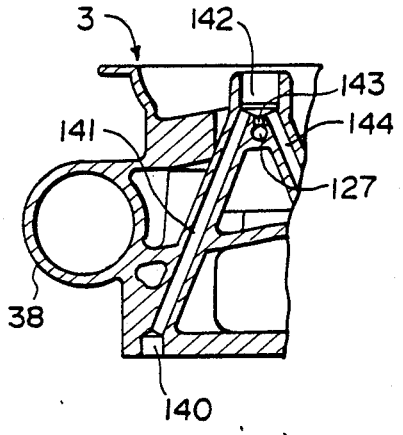
FIG. 8 is a cross-sectional view taken along line VIII—VIII in FIG. 2.

As shown in FIG. 8, the first cylinder head 3 is further provided with a lubricant introduction passage 141 which opens in the lower surface of the cylinder head at a lubricant introduction port 140. The lubricant introduction passage 141 extends obliquely upward from the port 140 and opens to an oil well 142 formed in an upper portion of the cylinder head 3. The inner lubricant passage 127 is just below the oil well 142 and is communicated therewith by a passage 143. The outer lubricant passage 126 is communicated with the oil well 142 by another passage 144. The second cylinder head 4 is also provided with the similar lubricant feeding system. The lubricant fed from the cylinder block 2 under pressure flows into the oil well 142 through the lubricant introduction port 140 and the lubricant introduction passage 141, and from the oil well, the lubricant is fed to the outer and inner lubricant passages 126 and 127 and to the bearings 26, 27, 28, 33, 34, 35, 36 and 103 through the communicating passages 124, 125 and 129 to 135. When the engine stopped, the lubricant in the lubricant introduction passage 141 returns to the cylinder head 2 but the lubricant remains in the outer and inner lubricant passages 126 and 127 due to the oil well 142. Accordingly, the lubricant can be quickly fed to the bearings when the engine is restarted.

As can be understood from the description above, in accordance with this embodiment, the bearings on opposite sides of the helical gears, i.e., the second power transmission mechanism, can be lubricated and the air in the oil passages can be removed with a simple structure.

We claim:

1. A valve train for a V-type double overhead camshaft engine which has first and second cylinder heads respectively forming first and second cylinder banks whose cylinder rows are offset from each other in the direction of the crankshaft so that the end of the cylinder row in the first cylinder bank on one end of the engine retracts from that of the cylinder row in the second cylinder bank, and in which a first camshaft in each cylinder bank is drivingly connected to the crankshaft of the engine by a first power transmission mechanism which is disposed on the end of the respective cylinder banks on said one end of the engine, and the first camshaft in each cylinder bank is drivingly connected with a second camshaft by a second power transmission mechanism which is disposed between the first power transmission mechanism and the cylinder row of the cylinder bank, characterized in that the end portion of said first camshaft in the first cylinder bank which extends beyond the end of the cylinder row on said one end of the engine is supported by a pair of bearings one disposed between the first and second power transmission mechanisms and the other disposed between the second power transmission mechanism and the cylinder row in the first cylinder bank, the end portion of said second camshaft in the first cylinder bank which extends beyond the end of the cylinder row on said one end of the engine is supported by a bearing disposed between the second power transmission mechanism and the cylinder row in the first cylinder bank, and the end portion of the first camshaft in the second cylinder bank which extends beyond the end of the cylinder row on said one end of the engine is supported by a bearing disposed between the first and second power transmission mechanisms, the end portion of said second camshaft in the second cylinder bank which extends beyond the end of the cylinder row on the one end of the engine is supported by a bearing disposed beyond said second power transmission mechanism on a side opposite said cylinder row.

2. A valve train as defined in claim 1 in which said second power transmission mechanism comprises a pair of gears respectively mounted on the first and second camshafts.

3. A valve train as defined in claim 1 in which said bearings which support the first and second camshafts in the first cylinder bank between the second power transmission mechanism and the cylinder rows are provided with thrust limiting means for limiting the axial movement of the camshafts, and said second cylinder bank is provided with thrust limiting means for limiting the axial movement of the first and second camshafts on the other end of the engine.

4. A valve train as defined in claim 3 in which said second power transmission mechanism comprises a pair of gears respectively mounted on the first and second camshafts.

5. A valve train as defined in claim 4 in which said thrust limiting means in the first cylinder bank comprises a thrust limiting groove formed in each of said bearings which support the first and second camshafts in the first cylinder bank between the second power transmission mechanism and the cylinder rows and an engaging portions formed on the corresponding camshaft, and the thrust limiting means in the second cylinder bank comprises a thrust limiting groove formed in each of bearings which support the first and second camshafts in the second cylinder bank at said the other end of the engine and an engaging portions formed on the corresponding camshaft.

6. A valve train as defined in claim 5 in which said first camshaft in the first cylinder bank is disposed on the outer side of the second camshaft, the first cylinder head is provided with an outer lubricant passage which extends along the first camshaft and is radially spaced from the center of the bearing by a distance larger than the radius of the gear, and said bearings which support the end portion of said first camshaft in the first cylinder bank which extends beyond the end of the cylinder row are communicated with the outer lubricant passage, said bearing provided with the thrust limiting groove being communicated with the outer lubricant passage at the thrust limiting groove.

7. A valve train as defined in claim 6 in which said second cylinder head is provided with an outer lubricant passage which extends along the outer one of the camshafts in the second cylinder bank and is radially spaced from the center of the bearing by a distance larger than the radius of the gear, and the bearing which supports said end portion of the outer camshaft and bearing which supports the outer camshaft at said the other end of the engine are communicated with the outer lubricant passage, said bearing provided with the thrust limiting groove being communicated with the outer lubricant passage at the thrust limiting groove.

8. A valve train as defined in claim 7 in which a part of said thrust limiting groove has a width larger than the thickness of said engaging portion.

9. A valve train as defined in claim 7 in which each cylinder head is provided with an inner lubricant passage which extends along the inner one of the camshafts in the cylinder bank and communicates with said bearing.

10. A valve train as defined in claim 9 in which said outer and inner lubricant passages are communicated with the bearings respectively by way of outer and inner communicating passages which extend substantially vertical, the outer communicating passage being longer than the inner communicating passage.

11. A valve train as defined in claim 9 in which said outer and inner lubricant passages are fed with the lubricant from the cylinder block of the engine by way of a lubricant well which is disposed above the outer and inner lubricant passages.

* * * * *